US005723432A

United States Patent [19]

Beerse et al.

[11] Patent Number: 5,723,432

[45] Date of Patent: Mar. 3, 1998

[54] STABLE PUMPABLE LIQUID COMPOSITION OF ACYLOXY ALKANE AND PROCESS FOR THE STORAGE THEREOF

[75] Inventors: Peter William Beerse, Maineville; James Charles Dunbar, Cincinnati; Neil William Jordan, Cincinnati; Gary Lee Reed, Cincinnati, all of Ohio

[73] Assignee: The Proctor & Gamble Company, Cincinnati, Ohio

[21] Appl. No.: 677,991

[22] Filed: Jul. 10, 1996

Related U.S. Application Data

[63] Continuation of Ser. No. 528,185, Sep. 14, 1995, abandoned, which is a continuation of Ser. No. 161,185, Dec. 1, 1993, abandoned, which is a continuation of Ser. No. 831,595, Feb. 5, 1992, abandoned.

[51] Int. Cl.[6] ..... C11D 1/12; C11D 1/28; C11D 7/50

[52] U.S. Cl. ..... 510/447; 510/426; 510/437; 510/446; 510/451; 510/495

[58] Field of Search ..... 510/426, 437, 510/446, 447, 451, 495

[56] References Cited

U.S. PATENT DOCUMENTS

| | | | |
|---|---|---|---|
| 2,635,103 | 4/1953 | Molteni et al. | 260/400 |
| 2,857,370 | 10/1958 | Sundberg | 260/97.5 |
| 2,923,724 | 2/1960 | Anderson et al. | 260/400 |
| 3,004,049 | 10/1961 | Schenck | 260/400 |
| 3,320,292 | 5/1967 | Cahn et al. | 260/400 |
| 3,383,396 | 5/1968 | Cahn et al. | 260/400 |
| 3,394,155 | 7/1968 | Cahn et al. | 260/400 |
| 3,429,136 | 2/1969 | Holt et al. | 62/114 |
| 3,689,437 | 9/1972 | McLaughlin | 252/557 |
| 4,151,105 | 4/1979 | O'Roark | 252/145 |
| 4,180,470 | 12/1979 | Tokosh et al. | 252/121 |
| 4,335,025 | 6/1982 | Barker et al. | 252/550 |
| 4,401,578 | 8/1983 | Verbruggen | 252/8.8 |
| 4,426,299 | 1/1984 | Verbruggen | 252/8.8 |
| 4,515,721 | 5/1985 | Login et al. | 260/440 |
| 4,536,338 | 8/1985 | Urban et al. | 260/400 |
| 4,612,136 | 9/1986 | Novakovic et al. | 252/134 |
| 4,663,070 | 5/1987 | Dobrovonly et al. | 252/121 |
| 4,695,395 | 9/1987 | Caswell et al. | 252/121 |
| 4,790,956 | 12/1988 | Weipert et al. | 252/538 |
| 5,030,376 | 7/1991 | Lee et al. | 252/108 |
| 5,041,233 | 8/1991 | Kutny et al. | 252/121 |

FOREIGN PATENT DOCUMENTS

| | | | |
|---|---|---|---|
| 3442579-A | 5/1986 | Germany | C07C 143/08 |
| 3616843-A | 11/1987 | Germany | C07C 143/10 |
| 848463 | 5/1957 | United Kingdom . | |
| 2015561 | 9/1979 | United Kingdom | C11D 10/04 |

*Primary Examiner*—Paul Lieberman
*Assistant Examiner*—Gregory R. Delcotto
*Attorney, Agent, or Firm*—Tara M. Rosnell; Robert B. Aylor

[57] ABSTRACT

Liquid compositions comprising acyloxy alkane sulfonic acid salt, paraffin, water, optional salt reactant, and optional fatty acid are provided which have improved stability and pumpability. Also a method of preparing and a method of storing these composition are provided utilizing temperature and particle size limitations. The composition, method of making, and method of storing the composition provide improved storage stability, pumpability, and a decrease in processing time for the incorporation of the composition into finished bar formulations.

19 Claims, No Drawings

STABLE PUMPABLE LIQUID COMPOSITION OF ACYLOXY ALKANE AND PROCESS FOR THE STORAGE THEREOF

This is a continuation of application Ser. No. 08/528,185 filed on Sep. 14, 1995 which is a continuation of Ser. No. 08/161,185, filed on Dec. 1, 1993, now abandoned, which is a continuation of Ser. No. 07/831,595, filed on Feb. 5, 1992, now abandoned.

BACKGROUND OF THE INVENTION

1. Field of the Invention

This invention relates to the preparation and storage of surface active materials and, in particular, to the preparation of compositions containing salts of esters of fatty acids with hydroxy alkane sulfonic acids, e.g., isethionate, said esters, i.e., acyloxy alkane sulfonates, having the general formula RCOOR' $SO_3M$.

Isethionates are well known as valuable synthetic detergents and wetting agents. Although acyl isethionates are usually incorporated into bar soaps in the form of a powder, prill, flakes or paste, the use of molten acyl isethionates is also known. When a liquid, e.g., molten, form of acyl isethionate is utilized, it may be necessary to store or transport this liquid to another location prior to its incorporation into a bar composition. Chemical and phase stability problems may arise upon storage of an aqueous acyl isethionate composition prior to its incorporation into a finished bar product.

Detergent bars made with synthetic surfactants are difficult to process. In contrast, the processing of "soap bars" is readily accomplished by, e.g., milling, plodding, and molding. Soap becomes plastic when heated and can easily be plodded and molded under relatively low pressures, but most synthetic surfactants and detergent-filler combinations do not become plastic upon heating and the processing machinery often requires special designs. See U.S. Pat. No. 2,678,921, J. A. V. Turck, Jr., issued May 18, 1954, incorporated herein by reference. Ideal syndet bar processing should be fast and problem free in terms of premix storage, milling, plodding, and molding. Unfortunately, syndet bar processing sometimes falls short in this respect.

2. Description of Related Art

It is well known in the art to prepare surface active agents by direct esterification of the fatty acid with sodium isethionate under reduced pressure. U.S. Pat. No. 2,635,103, Molteni et al., issued Apr. 14, 1953, incorporated herein by reference, teaches direct esterification. This process, however, requires an excess of the water-soluble hydroxyethylsulphonic acid salt and high temperatures from 200°–300° C. High salt content results in, and produces, hygroscopic bar soaps and the excess salt is expensive to remove. In addition, high temperatures produce strong discoloration of the end product. The process therefore has to be carried out under the cover of an inert gas. The reaction is also incomplete despite several hours of reaction time so that the excess fatty acid must be distilled off.

To reduce discoloration, the prior art teaches the use of catalysts to accelerate the reaction time and the purification of the crude reaction product to remove impurities. The following teach the use of catalysts: U.S. Pat. No. 2,857,370, Sundberg, issued Oct. 21, 1958, (discloses a process of heating carboxylic acid with an alkali metal, etc., in the presence of a boron-containing compound as a catalyst); U.S. Pat. No. 2,923,724, Anderson et al., issued Feb. 2, 1960, (process of heating carboxylic acid with an alkali metal, etc., in the presence of a phosphorous-containing compound as a catalyst); Brit. Pat. No. 848,463, Van Alphen et al., published Sept. 14, 1960, (teaches the addition of a salt of a weak base and strong inorganic or strong organic acid such as aluminum chloride, aluminum sulphate, etc., as a catalyst); U.S. Pat. No. 3,004,049, Schenck, issued Oct. 10, 1961, (a process whereby carboxylic acid and the isethionic acid salt is carried out in the presence of a catalytic amount of hypophosphorous acid or its salt); U.S. Pat. No. 3,320,292, Cahn et al., issued May 16, 1967, (process of direct esterification whereby zinc oxide or zinc salts of aliphatic acids, i.e., zinc soap, or mixtures thereof, are used as a catalyst); U.S. Pat. No. 3,383,396, Cahn et al., issued May 14, 1968, (process of preparation of surface active agents using soluble zirconium or zirconyl soaps as catalyst); U.S. Pat. No. 4,405,526, Lamberti et al., issued Sept. 20, 1983, (a process of direct esterification utilizing a mixed catalyst system comprising a mixture of zinc oxide and organic sulfonic acid). All of said patents are incorporated herein by reference.

U.S. Pat. No. 3,429,136, Holt et al., issued Feb. 25, 1969, incorporated herein by reference, teaches that discoloration and odor problems can be avoided by flash cooling molten ester during direct esterification by injecting 1–50 lbs. of water per pound of ester mass into the hot molten ester mass rather than cooling the mass in a closed system comprised of an inert atmospheric gas. In addition, other non-volatile detergent ingredients such as suds boosters, builders, binders, plasticizers, and colorants, can be injected into the ester-containing mass to eliminate additional mixing steps. Thereafter, the product obtained may be directly blended with volatile ingredients without further substantial mixing.

With direct esterification, it is well known in the art to utilize an excess of the acid reactant per mole of the second reactant to maintain the product in liquid form during the reaction and to reduce the formation of foam which requires very large reaction vessels. The excess acid reactant produces a higher utilization of the second reactant by forcing the condensation reaction to go forward.

Unfortunately, the use of excess acid reactant leads to a high amount of unreacted fatty acid in the crude reaction product. In addition to distillation and neutralization to remove this unreacted fatty acid, U.S. Pat. No. 3,394,155, Cahn et al., issued Jul. 23, 1968, incorporated herein by reference, teaches the addition of fatty acid in two steps to avoid this problem. A reduction in the lower molecular weight unreacted fatty acid allows for improvement in odor, mildness, and plodding characteristics of the finished bar product. In addition, the distillation step is reduced.

Furthermore, U.S. Pat. No. 4,515,721, Login et al., issued May 7, 1985, incorporated herein by reference, teaches the use of a quench liquid for rapid cooling and to remove unreacted fatty acids and impurities in the crude reaction mixture. The fatty acid ester should be insoluble, and the unreacted fatty acid should be soluble, in the quench liquid. Preferred quench liquids include organic liquids. Paraffin is also acceptable.

U.S. Pat. No. 4,536,338, Urban et al., issued Aug. 20, 1985, incorporated herein by reference, discloses the addition of an alkaline material to the reaction mass after completion of the esterification reaction to prevent unwanted transesterification between coconut isethionate ester and a high molecular weight fatty acid. This alkaline material quenches the reaction by neutralizing the acidic catalyst.

U.S. Pat. No. 4,335,025, Barker et al., issued Jun. 15, 1982, incorporated herein by reference, teaches detergent bars prepared in situ containing alkyl sulfosuccinate, surfactant, waxy extender such as paraffin, and water.

It is known in the art that the viscosity of the reaction mass increases as esterification continues and as the excess fatty acid is distilled off. Handling of the reaction mass and proper homogenization become more difficult. To reduce this problem, German Patent Application No. 3,442,579, Zok, published May 22, 1986, incorporated herein by reference, teaches direct esterification in the presence of a consistency regulator to reduce viscosity of the reaction mixture. Esters of synthetic or natural fatty acids, preferably methyl esters of $C_{12}$–$C_{18}$ aliphatic carboxylic acids are used as the consistency regulator. Less energy is utilized for mixing which is more rapid and complete. Also, high performance mixers are not needed. The consistency regulator is to be distilled off with the excess fatty acid from the end reaction product.

German Patent Application No. 3,616,843, Bunzel et al., published Nov. 19, 1987, incorporated herein by reference, is a continuation of Application No. 3,442,579, above, in which 1.5–15% by weight of paraffin is used as the consistency regulator. This paraffin can be solid, semi-solid, or liquid at room temperature, preferably having a chain length of at least $C_{16}$. Microcrystalline wax (Microwax) and refined table paraffin are suitable.

The use of paraffin to provide anti-gelling and viscosity control effects in aqueous dispersions of cationic fabric softeners is also taught in the art. See, e.g., U.S. Pat. No. 4,401,578, Verbruggen, issued Aug. 30, 1983, and U.S. No. Pat. 4,426,299, Verbruggen, issued Jan. 17, 1984, said patents being incorporated herein by reference.

All of the above patents are incorporated herein by reference.

An object of the present invention is to provide a composition containing acyloxy alkane sulfonic acid salt with improved storage stability and pumpability which can more easily be processed directly into finished bar products, thus decreasing processing time. Another object of the present invention is to provide an improved process for making bar formulations. A further object of this invention is to provide an improved process for storage of liquid acyloxy alkane sulfonic acid compositions prior to incorporation into finished bar formulations.

SUMMARY OF THE INVENTION

The present invention relates to a pumpable, stable, liquid composition comprising from about 20% to about 60% acyloxy alkane sulfonic acid salt, from about 2% to about 50% paraffin, from about 20% to about 55% water, more preferably 35% to 45% water, and from 0% to about 7% hydroxy alkane sulfonic acid salt reactant of the formula HOR'SO3M where R' is an alkenyl radical containing from 2 to about 5 carbon atoms and M is a compatible cation, and, optionally, from about 5% to about 25% fatty acid.

The temperature of the composition is from about 100° F. (38° C.) to about 160° F. (71° C.), preferably from about 115° F. (46° C.) to about 140° F. (60° C.), more preferably from about 115° F. (46° C.) to about 125° F. (52° C.). The temperature should be at least sufficient to maintain the fluidity of the composition. The particle size of the liquid crystalline components of the composition is less than about 50 microns, preferably less than about 20 microns, more preferably less than about 10 microns. The pH of the composition is from about 5 to about 7.5, preferably from about 6 to about 7.

The present invention also relates to an improved process for making a pumpable, stable, liquid (molten) composition of the type described hereinbefore for incorporation into finished bar compositions comprising the following steps:

(a) heat the fatty acid, if present, and paraffin, either separately, or together, to or above their melting point (s);

(b) add the acyloxy alkane sulfonic acid salt, any salt reactant, and water to the mixture of (a); and (c) cool the composition to a temperature of from about 100° F. (38° C.) to about 160° F. (71° C.), preferably from about 115° F. (46° C.) to about 140° F. (60° C.), more preferably from about 115° F. (46° C.) to about 125° F. (52° C.), and even more preferably about 120°±5° F. (49°±3° C.);

wherein the composition is subjected to continuous mixing with a shear rate of from about 6 $sec.^{-1}$ to about 30,000 sec.⁻1, preferably a shear rate of from about 60 $sec.^{-1}$ to about 9,000 $sec.^{-1}$ until obtaining a particle size of the liquid crystalline components of from less than about 50 microns or the particle size set hereinabove.

This invention also relates to the method of storing this pumpable, stable, molten composition where the particle size of the composition is maintained at less than about 50 microns, preferably less than about 20 microns, more preferably less than about 10 microns, and the temperature of the composition is maintained at from about 115° F. (46° C.) to about 125° F. (52° C.), preferably about 120°±5° F. (49°±3° C.).

The percentages, ratios, and parts herein are on a total composition or surfactant weight basis, as indicated, unless otherwise specified.

The composition, method of making, and method of storage of this composition provide improved storage stability, pumpability, and a decrease in processing time for incorporation of this composition into finished bar formulations.

DETAILED DESCRIPTION OF THE INVENTION

Acyloxy Alkane Sulfonic Acid

The surfactant of the present invention is a salt of acyloxy alkane sulfonic acid which is, preferably, a salt of an aliphatic higher fatty acid ester of isethionic acid. The general formula of these acyloxy alkane sulfonic acid salts is $RCOOR'SO_3M$ and they are formed by the esterification of an alcohol of the formula $HOR'SO_3M$ with an organic acid of the formula RCOOH. Each R is a monovalent aliphatic hydrocarbon radical having from about 5 to about 19 carbon atoms, preferably from about 7 to about 17 carbon atoms, e.g., cocoyl or an approximately equivalent distribution of chain lengths. Each R' is a divalent aliphatic hydrocarbon radical containing from about 2 to about 5 carbon atoms, preferably from about 2 to about 4 carbon atoms and each M is an alkali metal (e.g., sodium, potassium, lithium), an alkaline earth metal (e.g., calcium, magnesium), or an ammonium or an organic amine base such as triethanolammonium, triisopropanolammonium, diethanolammonium or ethanolammonium. The preferred cation is sodium. The level of acyloxy alkane sulfonic acid salt in the storage stable liquid compositions herein is from about 20% to about 60%, preferably from about 30% to about 50%, more preferably from about 35% to about 40%. The isethionate can contain pure chain length acyloxy variants, or those derived from commercial oils such as coconut oils. Preferred storage stable compositions include from about 35% to about 40% of sodium cocoyl isethionate.

Specifications for surface active agents in detergent compositions require the absence of colored impurities in order to prepare high quality, aesthetically pleasant, formulated products such as detergent bars. The absence of impurities minimizes off-odor and bar feel problems.

Paraffin

Paraffins are aliphatic hydrocarbons which can be liquid, semi-solid, or solid at room temperature. The generic formula is $C_n H_{2n+2}$. Paraffins of the present invention have a chain length of from about 16 to about 55, preferably from about 17 to about 50, carbon atoms. The paraffin has a melting point of from about 115° F. to about 180° F. (46°–82° C.), preferably from about 140° F. to about 165° F. (60°–74° C.), and more preferably from about 142° F. to about 160° F. (61°–71° C.).

A preferred paraffin wax is a fully refined petroleum wax which is odorless and tasteless and meets FDA requirements for use as coatings for food and food packages. Such paraffins are readily available commercially.

The paraffin wax preferably is present in the storage stable composition in an amount ranging from about 2% to about 50%, preferably from about 5% to about 12%, more preferably from about 6% to about 10%. Paraffin wax lowers viscosity to improve processability of the composition of the present invention. It also enhances bar firmness, plasticity, and smoothness in the end bar product. Paraffin also provides a glossy look to the finished bar product.

Microwax (microcrystalline wax) is also a suitable paraffin. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. Microcrystalline wax also imparts pliability to the finished bar at room temperatures.

Odorless and colorless paraffins are preferred. Paraffin mixtures can also be used.

Salt Reactant

The composition of the present invention has an optional, but highly preferred, salt reactant component of the formula $HOR'SO_3M$ where R' is divalent hydrocarbon moiety which contains from 2 to about 5, preferably from 2 to 4 carbon atoms, and M is as defined hereinbefore. Preferably, R' is an ethylene, methylethylene, dimethylethylene, propylene, or butylene radical. R' can also be a dialkylene ether radical, such as the radical $—CH_2CH_2OCH_2CH_2—$. Frequently, it will be convenient to use as the salt reactant a compound which has been prepared by the reaction of an epoxide, for example, ethylene oxide, propylene oxide, or butylene oxide, with sodium bisulphite.

Examples of compounds suitable for use as the salt reactant are sodium isethionate, sodium methylisethionate, sodium dimethylisethionate and sodium 3-hydroxypropanesulphonate. Preferably the salt reactant is sodium isethionate.

The salt reactant is from about 0% to about 7%, preferably from about 4% to about 6% by weight of the composition.

Fatty Acid

The present invention has an optional, but highly preferred, fatty acid component of at least about six (6) carbon atoms. The addition of fatty acid to the above premix results in an increase in the fluidity of the composition. The fatty acid can be branched, saturated, unsaturated, aliphatic, or cyclic aliphatic. The carbon chain length ranges from about 6 to about 22 carbon atoms, preferably from about 8 to about 20, more preferably from about 10 to about 18 carbon atoms, and is usually saturated. The fatty acid is from about 5% to about 25%, preferably from about 5% to about 15%, more preferably from about 6% to about 12% by weight of the composition. These fatty acids can be highly purified individual chain lengths and/or crude mixtures such as those derived from fats and oils. Useful acids include the following: caproic acid, caprylic acid, pelargonic acid, capric acid, lauric acid, myristic acid, palmitic acid, stearic acid, oleic acid, linolenic acid, tall oil acid, hydrogenated tall oil acids, and hydrogenated tallow acids. Acids from oxidized petroleum fractions can be employed. Acid mixtures from various natural plant and animal oils such as olive, tallow, castor, peanut, coconut, soybean, cottonseed, linseed, cod, herring, menhaden, neatsfoot, sperm, palm, corn, butter, babassu, kapok, hempseed, mustard, rubberseed, rape, safflower, sesame, etc., can also be employed.

Process of Preparing the Composition

The present invention also relates to an improved process for making a pumpable, stable, molten composition for incorporation into finished bar compositions comprising the following steps:

a) heat the fatty acid, if present, and paraffin described hereinbefore, either separately, or together, to or above, their melting point(s);

b) add the acyloxy alkane sulfonic acid salt, any salt reactant, and water to the mixture of (a); and (c) cool the composition to a temperature of from about 100° F. (38° C.) to about 160° F. (71° C.), preferably from about 115° F. (46° C.) to about 140° F. (60° C.), more preferably from about 115° F. (46° C.) to about 125° F. (52° C.), and even more preferably about 120°±5° F. (49°±3° C.);

wherein the composition is continuously mixed with high shear mixing, typically with a shear rate of from about 6 $sec.^{-1}$ to about 30,000 $sec.^{-1}$, preferably from about 60 $sec.^{-1}$ to about 9,000 $sec.^{-1}$, until obtaining particle sizes of less than about 50 microns, preferably less than about 20 microns, more preferably less than about 10 microns. Preferably the fatty acid and paraffin of Step (a) are mixed and heated together.

The melting point of the fatty acid depends on its chain-length. For example, the melting point of whole cut coconut having from about 6 to about 18 carbon atoms has a melting point of about 77° F. (25° C.).

The melting point of paraffin also depends on its chain-length. The paraffins of the present invention have a chain-length of from about 16 to about 55 carbon atoms. Therefore, the paraffins of the present invention preferably have a melting point of from about 115° F. to about 180° F. (46°–82° C.), preferably from about 140° F. to about 165° F. (60°–74° C.), more preferably from about 142° F. to about 160° F. (61°–71° C.).

Continuous mixing to form the desired particle size of the composition can be accomplished, e.g., with an Eppenbach Mixer. But any high shear mixer which will achieve these shear rates and the particle sizes above will suffice. The mixing of the composition should continue until the particle sizes outlined above are obtained.

Particle size can be measured by standard freeze fracture microscopy procedures which are disclosed in *Freeze Fracture Microscopy: Methods, Artifacts, Interpretation*, J. E.

Rash, C. S. Hudson, Raven Press, N.Y., 1991, incorporated herein by reference.

It is highly preferred that the composition of the present invention is cooled to a temperature at or about 120°±5° F. (49°±3° C.). If upon storage of the composition, localized cooling of the mass occurs, additional high shear mixing is necessary to reestablish the required particle sizes outlined above.

Utilizing this process provides compositions with improved storage stability (both chemical and phase stability) and pumpability so that the composition can more easily be incorporated into finished bar formulations.

The following examples illustrate this invention. These examples are not intended to limit the invention. The percentages, ratios, and parts herein are on a total composition or surfactant weight basis, as indicated, unless otherwise specified. All levels, ranges, temperatures, results, etc., are approximations unless otherwise specified.

EXAMPLE I

| Component | Approximate Percents by Weight |
|---|---|
| Sodium Cocoyl Isethionate | 37.05 |
| Paraffin (Melting Point ~158° F.) | 7.60 |
| Fatty Acid (mol. wt. 251) | 9.18 |
| Sodium Isethionate | 4.42 |
| Water | 39.43 |
| Catalyst By-Products and/or Impurities | 2.32 |

A storage stable, pumpable surfactant composition having the above formula is prepared by the following process:

(a) the fatty acid and paraffin are heated together to above their melting point temperatures (about 160° F., 71° C.);

(b) the sodium cocoyl isethionate, sodium isethionate, and water are heated to a temperature of about 160° F. (71° C.) and added to the mixture of Step (a); and (c) the composition is cooled to a temperature of about 120° F. (49° C.);

while the composition is subjected to continuous mixing with an Eppenbach Mixer using a shear rate of about 20,000 $sec.^{-1}$ until the particle size of the composition is, on an average, less than about 10 microns.

EXAMPLE II

Samples of the composition of Example I are stored for 6 days at, approximately, 120° F. (49° C.), 140° F. (60° C.), 160° F. (71° C.), and 180° F. (82° C.). These samples are monitored daily for the first 6 days. The level of hydrolysis of each sample is measured by measuring the level of sulfated/sulfonated surfactant level as determined via CAT $SO_3$ analysis.

TABLE 2

Approximate CAT $SO_3$ Percent (Proportional to the % of Surfactant Remaining)

| | | Days 1 through 6 | | | | | |
|---|---|---|---|---|---|---|---|
| Temperature | Day: | 1 | 2 | 3 | 4 | 5 | 6 |
| 120° F. (49° C.) | | 7.89 | 7.89 | 7.89 | 7.89 | 7.89 | 7.89 |
| 140° F. (60° C.) | | 7.90 | 7.90 | 7.81 | 7.68 | 7.57 | 7.52 |
| 160° F. (71° C.) | | 7.88 | 7.31 | 7.23 | 7.27 | 7.18 | 7.11 |
| 180° F. (82° C.) | | 7.81 | 7.25 | 7.08 | 7.03 | 6.74 | 5.82 |

The composition of the present invention begins to hydrolyze at temperatures greater than about 120° F. At a temperature of about 180° F., the hydrolysis is very rapid. The moisture level is 40%. No visual evidence of phase separation is observed with any of these samples. At 120° F., the composition is pumpable (K ~20,000 cP; N ~0.4) and chemically and physically stable.

Although preferred embodiments of the present invention are described above, modifications to these embodiments can be made without departing from the scope of this invention as set forth in the following claims.

What is claimed is:

1. A process of preparing a pumpable, stable, liquid composition comprising:

(a) from about 20% to about 60% acyloxy alkane sulfonic acid salt of the formula $RCOOR^1SO_3M$;

(b) from about 2% to about 50% paraffin; and (c) from about 35% to about 55% water;

wherein R is a hydrocarbyl with from about 5 to about 19 carbon atoms; $R^1$ is a divalent hydrocarbyl or dialkylene ether radical with from about 2 to about 5 carbon atoms; and M is an alkali metal, alkaline earth metal, ammonium or organic amino base; wherein said process comprises the steps of:

(A) heating the composition to a temperature of from about 100° F. (38° C.) to about 160° F. (71° C.); and (B) high shear mixing the composition until obtaining liquid crystalline components;

the liquid crystalline components having a particle size of less than about 50 microns, and the pH of the composition being from about 5 to about 7.5; wherein said liquid composition is stable at 120° F. for at least about 6 days.

2. The process according to claim 1 wherein the temperature is from about 115° F. (46° C.) to about 140° F. (60° C.), the particle size is less than about 20 microns, and the pH is from about 6 to about 7.

3. THe process according to claim 2 wherein the temperature is from about 115° F. (46° C.) to about 125° F. (52° C.) and the particle size is less than about 10 microns.

4. The process according to claim 1 wherein (a) is from about 35% to about 40%, (b) is from about 6% to about 10%, and (c) is from about 35% to about 45% by weight of the composition.

5. The process according to claim 4 wherein the temperature is from about 115° F. (46° C.) to about 140° F. (60° C.), the particle size is less than about 20 microns, and the pH is from about 6 to about 1.

6. The process according to claim 5 wherein the temperature is from about 115° F. (46° C.) to about 125° F. (52° C.) and the particle size is less than about 10 microns.

7. The process according to claim 4 wherein (a) is sodium cocoyl isethionate, and (b) is a paraffin having a melting point of about 158° F. (70° C.).

8. The process according to claim 7 wherein the temperature is from about 115° F. (46° C.) to about 140° F. (60° C.), the particle size is less than about 20 microns, and the pH is from about 6 to about 7.

9. The process according to claim 8 wherein the temperature is from about 115° F. (46° C.) to about 125° F. (52° C.) and the particle size is less than about 10 microns.

10. The process of preparing the composition of claim 1 comprising the following steps:

(C) heating any of said paraffin to at least its melting point;

(D) adding said acyloxy alkane sulfonic acid salt, and water to the melted paraffin of (C);

(E) adjusting the temperature of the composition to a temperature of from about 100° F. (38° C.) to about 160° F. (71° C.); and (F) continuously mixing the composition with a shear rate of from about 6 $sec.^{-1}$ to about 30,000 $sec.^{-1}$ to form a particle size of less than about 50 microns for the liquid crystalline compounds.

11. The process according to claim 10 wherein the temperature is from about 115° F. (46° C.) to about 140° F. (60° C.) and the particle size is less than about 20 microns.

12. The process according to claim 11 wherein the temperature is from about 115° F. (46° C.) to about 125° F. (52° C.) and the particle size is less than about 10 microns.

13. The process according to claim 1 wherein said liquid composition additionally comprises:

(d) up to about 7% salt reactant of the formula $HOR^1SO_3M$; and (e) from about 5% to about 25% fatty acid.

14. The process according to claim 13 wherein the temperature is from about 115° F. (46° C.) to about 140° F. (52° C.), the particle size is less than about 20 microns, and the pH is from about 6 to about 7.

15. The process according to claim 14 wherein the temperature is from about 115° F. (46° C.) to about 125° F. (52° C.) and the particle size is less than about 10 microns.

16. The process according to claim 13 wherein (a) is from about 35% to about 40% of sodium cocoyl isethionate, (b) is from about 6% to about 10% of a paraffin having a melting point of about 158° F. (70° C.), (c) is from about 35% to about 45% water, (d) is from about 4% to about 6% of sodium isethionate, and (e) is from about 6% to about 12% of a C6–C18 fatty acid.

17. The process according to claim 16 wherein the temperature is from about 115° F. (46° C.) to about 140° F. (52° C.), the particle size is less than about 20 microns, and the pH is from about 6 to about 7.

18. The process according to claim 17 wherein the temperature is from about 115° F. (46° C.) to about 125° F. (52° C.) and the particle size is less than about 10 microns.

19. The process according to claim 13 wherein said liquid composition comprises from about 5% to about 15% fatty acid.

* * * * *